US010442614B2

(12) United States Patent
Lucas et al.

(10) Patent No.: US 10,442,614 B2
(45) Date of Patent: Oct. 15, 2019

(54) SEMI-RIGID BULK MATERIAL STORAGE CONTAINER

(71) Applicant: Halliburton Energy Services, Inc., Houston, TX (US)

(72) Inventors: Bryan Chapman Lucas, Duncan, OK (US); Calvin L. Stegemoeller, Duncan, OK (US); Wesley John Warren, Marlow, OK (US); Austin Carl Schaffner, Duncan, OK (US); Tim H. Hunter, Duncan, OK (US); Bryan John Lewis, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/064,298

(22) PCT Filed: Feb. 26, 2016

(86) PCT No.: PCT/US2016/019689

§ 371 (c)(1),
(2) Date: Jun. 20, 2018

(87) PCT Pub. No.: WO2017/146715

PCT Pub. Date: Aug. 31, 2017

(65) Prior Publication Data

US 2019/0002196 A1 Jan. 3, 2019

(51) Int. Cl.
*B65D 88/30* (2006.01)
*B65D 90/02* (2019.01)
(Continued)

(52) U.S. Cl.
CPC ..... *B65D 88/30* (2013.01); *B65D 90/02* (2013.01); *B65D 90/022* (2013.01); *B65D 90/20* (2013.01);
(Continued)

(58) Field of Classification Search
CPC .. B65D 2588/125; B65D 88/30; B65D 90/20; B65D 88/128; B65D 88/26; B65D 88/32; B65D 88/12; B65D 88/129; B65D 90/205
See application file for complete search history.

(56) References Cited

U.S. PATENT DOCUMENTS 4,660,733 A * 4/1987 Snyder ..... B65D 88/08 220/634
5,692,868 A 12/1997 Riemersma
(Continued)

FOREIGN PATENT DOCUMENTS

EP 1598288 A1 11/2005
WO 2017/095423 A1 6/2018

OTHER PUBLICATIONS

International Preliminary Report on Patentabiltiy issued in related PCT Application No. PCT/US2016/019689 dated Sep. 7, 2018, 12 pages.

(Continued)

*Primary Examiner* — Mark C Hageman
(74) *Attorney, Agent, or Firm* — John Wustenberg; Baker Botts L.L.P.

(57) ABSTRACT

In accordance with presently disclosed embodiments, a stackable bulk material storage container is provided. The bulk material storage container includes a frame having a top portion and a bottom portion, which is supported by a plurality of rigid bars. A semi-rigid containment structure is further provided, which is supported by the frame. The semi-rigid containment structure may be formed of a plurality of interconnected or attached panels of thin steel sheets, carbon graphite or fiber reinforced plastic. Alternatively, the semi-rigid containment structure may be integrally formed of a roto-molded plastic material. The frame optionally has an opening at the top, which is sized to allow
(Continued)

for easy removal and replacement of the semi-rigid containment structure.

12 Claims, 4 Drawing Sheets

(51) Int. Cl.
*B65D 90/54* (2006.01)
*B65D 90/20* (2006.01)

(52) U.S. Cl.
CPC ..... *B65D 90/54* (2013.01); *B65D 2588/125* (2013.01)

(56) References Cited

U.S. PATENT DOCUMENTS 6,244,459 B1 6/2001 Bouc et al.
6,401,983 B1 * 6/2002 McDonald ..... B60P 1/56 220/1.5
7,475,796 B2 * 1/2009 Garton ..... B65D 88/128 211/153
7,819,269 B2 10/2010 Perkins
8,100,264 B2 1/2012 Wood et al.
8,646,641 B2 * 2/2014 Moir ..... B65D 88/128 206/386
8,863,978 B2 10/2014 Przytulla et al.
9,902,927 B2 * 2/2018 Slattery ..... B65D 77/0466
2004/0089659 A1 * 5/2004 Schutz ..... B29C 49/0073 220/9.1
2009/0008410 A1 1/2009 Kosich
2014/0083554 A1 * 3/2014 Harris ..... B65D 88/32 141/1
2014/0109992 A1 * 4/2014 Ness ..... B65D 19/385 137/376
2015/0086307 A1 * 3/2015 Stefan ..... B65D 88/005 414/304

OTHER PUBLICATIONS

International Search Report and Written Opinion issued in related PCT Application No. PCT/US2016/019689 dated Nov. 22, 2016, 15 pages.

* cited by examiner

SEMI-RIGID BULK MATERIAL STORAGE CONTAINER

CROSS-REFERENCE TO RELATED APPLICATION

The present application is a U.S. National Stage Application of International Application No. PCT/US2016/019689 filed Feb. 26, 2016, which is incorporated herein by reference in its entirety for all purposes.

TECHNICAL FIELD

The present disclosure relates generally to the handling of dry bulk materials, and more particularly, to a semi-rigid bulk material storage container for use in the storage, transportation and dispensation of such dry bulk materials.

BACKGROUND

During the drilling and completion of oil and gas wells, various wellbore treating fluids are used for a number of purposes. For example, high viscosity gels are used to create fractures in oil and gas bearing formations to increase production. High viscosity and high density gels are also used to maintain positive hydrostatic pressure in the well while limiting flow of well fluids into earth formations during installation of completion equipment. High viscosity fluids are used to flow sand into wells during gravel packing operations. The high viscosity fluids are normally produced by mixing dry powder and/or granular materials and agents with water at the well site as they are needed for the particular treatment. Systems for metering and mixing the various materials are normally portable, e.g., skid- or truck-mounted, since they are needed for only short periods of time at a well site.

The powder or granular treating material is normally transported to a well site in a commercial or common carrier tank truck. Once the tank truck and mixing system are at the well site, the dry powder material (bulk material) must be transferred or conveyed from the tank truck into a supply tank for metering into a blender as needed. The bulk material is usually transferred from the tank truck pneumatically. More specifically, the bulk material is blown pneumatically from the tank truck into an on-location storage/delivery system (e.g., silo). The storage/delivery system may then deliver the bulk material onto a conveyor or into a hopper, which meters the bulk material through a chute into a blender tub.

Recent developments in bulk material handling operations involve the use of portable containers for transporting dry material about a well location. The containers can be brought in on trucks, unloaded, stored on location, and manipulated about the well site when the material is needed. The containers are generally easier to manipulate on location than a large supply tank trailer. The containers are eventually emptied by dumping the contents thereof onto a mechanical conveying system (e.g., conveyor belt, auger, bucket lift, etc.). The conveying system then moves the bulk material in a metered fashion to a desired destination at the well site.

Currently, most containers that are used for proppant handling with respect to hydraulic fracturing operations are steel. Steel is readily available and very familiar for many supply chain operators and has great characteristics with respect to strength and durability. However, steel is a very dense material and many of the operations or procedures used when handling the material can be very expensive. This includes the equipment used for manufacturing processes (brake, saw, welding machines, etc.) as well as the manual labor needed to complete the manufacturing processes. Many of these issues have been addressed with the design of a soft-sided container, which is the subject of a separate application filed by the assignee of the present application hereof That application was filed on Dec. 3, 2015 and has been assigned Serial No. PCT/US2015/063773.

The present disclosure presents another approach at addressing many of these same issues by employing a semi-rigid container the details of which are discussed in further detail herein.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
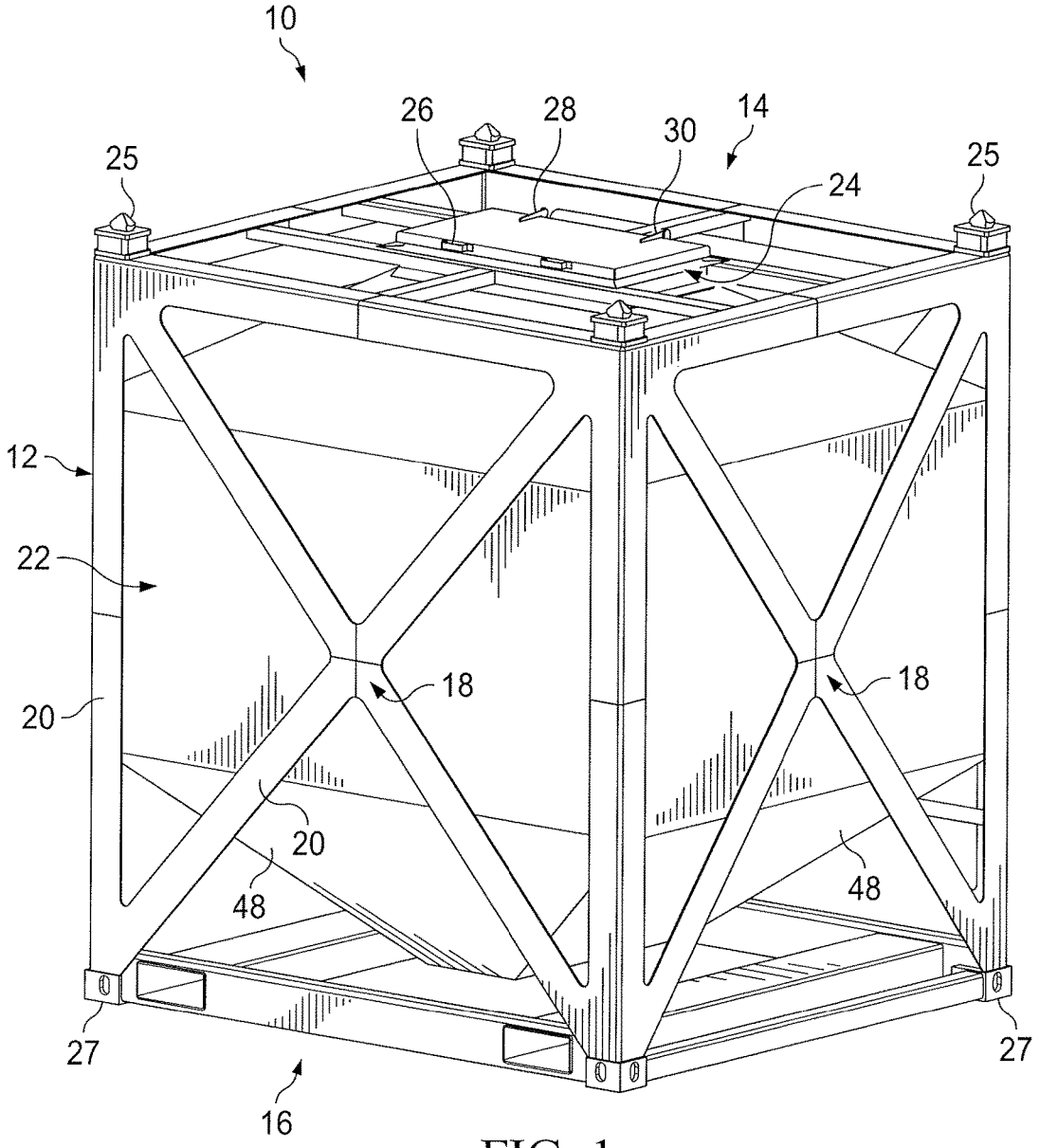
FIG. 1 is an isometric view of a semi-rigid panel-type bulk material storage container, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for efficiently managing bulk material (e.g., bulk solid or liquid material). Bulk material handling systems are used in a wide variety of contexts including, but not limited to, drilling and completion of oil and gas wells, concrete mixing applications, agriculture, and others. The disclosed embodiments are directed to systems for efficiently moving bulk material into a blender inlet of a blender unit at a job site. The systems may include a portable support structure used to receive one or more portable containers of bulk material and output bulk material from the containers directly into the blender inlet. The disclosed techniques may be used to efficiently handle any desirable bulk material having a solid or liquid constituency including, but not limited to, sand, proppant, gel particulate, diverting agent, dry-gel particulate, liquid additives and others.

In currently existing on-site bulk material handling applications, dry material (e.g., sand, proppant, gel particulate, or dry-gel particulate) may be used during the formation of treatment fluids. In such applications, the bulk material is often transferred between transportation units, storage tanks, blenders, and other on-site components via pneumatic transfer, sand screws, chutes, conveyor belts, and other components. Recently, a new method for transferring bulk material to a hydraulic fracturing site involves using portable containers to transport the bulk material. The containers can be brought in on trucks, unloaded, stored on location, and manipulated about the site when the material is needed. These containers generally include a discharge gate at the bottom that can be actuated to empty the material contents of the container at a desired time.

The present disclosure is directed to the use of a semi rigid material for the containment structure. The semi-rigid material may comprise a thin sheet of steel, a roto-molded polyethylene (polypropylene, polycarbonate, polyvinyl chloride, combinations thereof or similar thermoplastic material), fiber reinforced plastic, carbon graphite panels, or other light, semi-rigid yet strong material. The roto-molded material/process approach can have use in other container applications. It is also a cost effective solution because the containers can be manufactured in high quantities for low cost. There is no welding required with these approaches, which significantly reduces the manufacturing time and thus associated cost of manufacture. Also, the roto-molded polyethylene approach is also a very light yet strong material. A roto-molded container could be used in bulk storage as set forth herein.

Furthermore, the containers in accordance with the present disclosure are intended to be stackable, when being transported or stored and also when being placed on a frame above a blender or mixer for dispensing. To facilitate their stacking, each container frame must be robust enough to carry the weight of its stack. Furthermore, each frame is equipped with alignment pins to facilitate the stacking of the containers.

Figure 2:
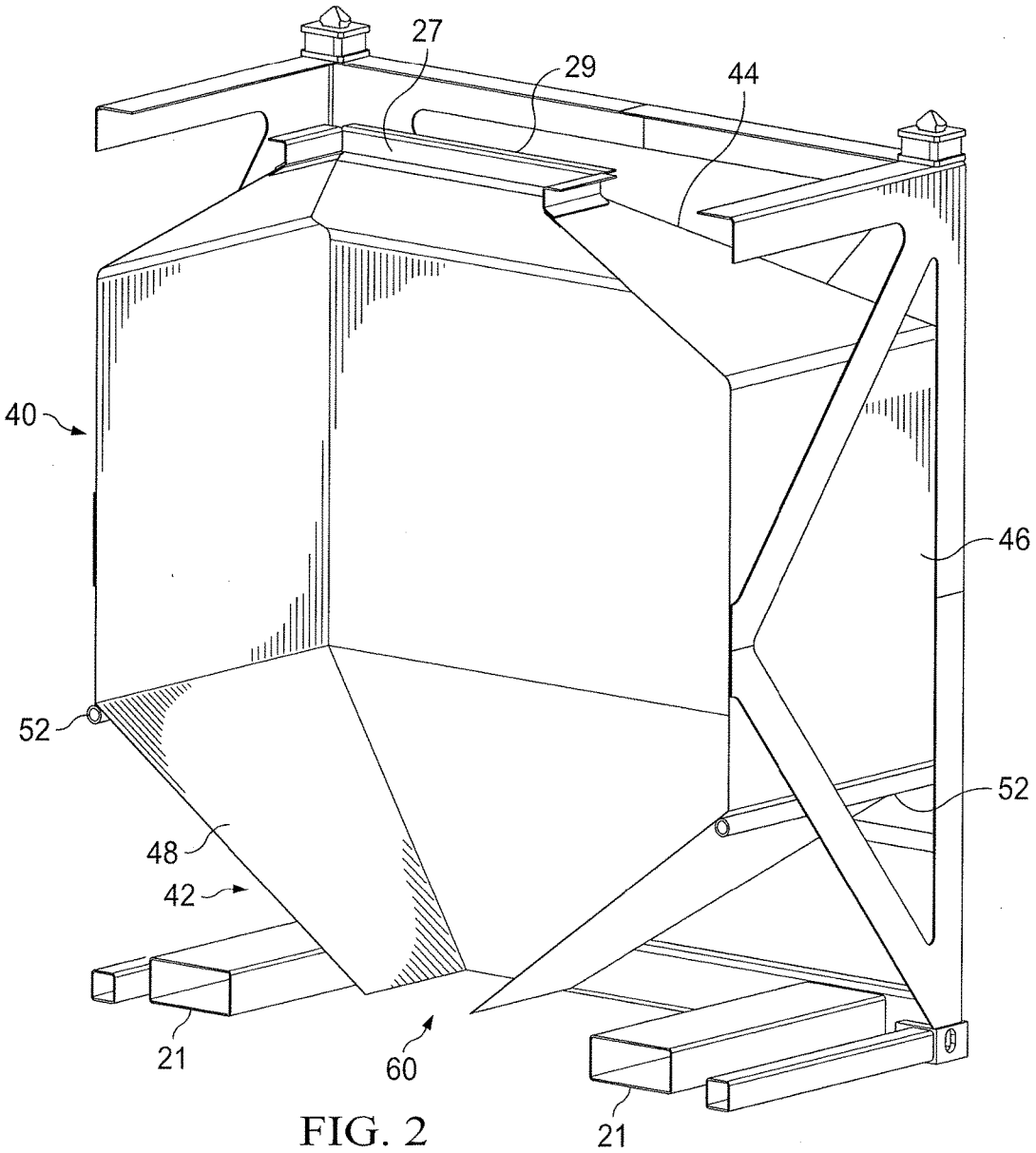
FIG. 2 is a cutaway perspective view of an alternate embodiment of the semi-rigid panel-type bulk material storage container shown in FIG. 1 revealing the inside of a containment structure of the bulk material storage container.

Turning now to the drawings, FIG. 1 illustrates a schematic diagram of a semi-rigid bulk material storage container 10 in accordance with the present disclosure. The container 10 includes a frame 12, which includes a top 14, a bottom 16 and a plurality of sides 18. The frame is formed of a plurality of interconnected rigid bars 20, which in one exemplary embodiment may be formed of steel. As those of ordinary skill in the art will appreciate, however, alternative rigid materials may be used in the construction of the frame 12. The grade/weight of steel or other rigid material utilized should be able to carry the weight of multiple containers such as when the containers are stacked. A pair of parallel channels 21 is attached to the bottom 16 of the frame 12 at generally opposite sides, as shown in FIG. 2. The channels 21 have a general rectangular cross-section and are designed to accommodate the forks of a forklift. This enables the containers 10 to be easily hoisted onto and off transportation units (not shown) and also moved around a well site.

One of the features of the frame 12 is that the rigid bars 20 are formed at least on the sides into a cross-bar configuration. These cross-bars reinforce the frame 12. Unlike prior art bulk material storage containers, whose frames are made up of solid panels, frame 12 simply relies on the cross-bars to give it form and strength. This configuration results in a lighter-weight container 10 which has a greater capacity for storage of bulk material. Indeed, the reduction in material making up the frame 12 together with the use of light weight semi-rigid material used to form the storage containment structure 22 reduces the overall weight of the container by approximately 31% or more over prior art containers. This weight savings will allow an approximate additional 2,000 lbs. of dry bulk material to be transported in each container, which results in an approximate 5% increase over current capacity of existing conventional bulk material storage containers. Furthermore, the fabrication expenses associated with the design of the present bulk material storage container 10 will also result in a significant reduction in the fabrication cost for the containers. It is estimated that by eliminating the conventional side panels and associated welding of same, that a reduction of approximately 100 hours of fabrication time will result in connection with the manufacture of the bulk storage material containers 10, in accordance with the present disclosure.

An inlet 24 is located in the top 14 of the frame 12. The inlet 24 is formed by two orthogonal pairs of parallel cross bars. One or more hatches 26 may be mounted to the inlet 24 by a pair of hinges 28 and 30. The pair of hinges 28 and 30 enables the hatch to swing between an open position and a closed position. In the open position, dry bulk material can be disposed into the container 10 through the opening 24. In the closed position, the dry bulk material is contained within the container 10 thereby preventing it from being lost to the environment or exposed to undesired moisture. Bulk material loss can be an issue during transport and in windy environments. Thus, the hatch 26 assists in the containment of the bulk material storage. The container 10 is also formed with a plurality of alignment pins 25 disposed on the top 14 of the frame 12 and an associated plurality of alignment recesses 27 disposed on the bottom of the frame 12. The associated alignment recesses 27 are designed to receive the alignment pins 25 from another container 10 to thereby enable stacking of the containers 10.

The storage containment structure 22 is formed of an upper portion 40 and a lower portion 42, which are best seen in FIG. 2. The upper portion 40 is formed of a semi-rigid material, such as, e.g., thin sheets of steel, carbon graphite panels, or fiber reinforced plastic panels. The bottom portion 42 is formed of the same semi-rigid material, which is used to form the upper portion 40. The panels can be formed together using structural adhesives, rivets, threaded fasteners, welding (steel or thermoplastic) or a combination of any of these techniques. As those of ordinary skill in the art will appreciate, other suitable materials and attachment techniques may be used.

The upper portion 40 of the storage containment structure 22 has a top section 44, a mid-section 46 and bottom section 48. The mid-section 46 is formed of a plurality of side panels, which are attached to each other at adjacent corners. The side panels are attached at right angles to each other (i.e., 90° angles). The top section 44 is formed of a plurality of upwardly tapered panels, which are attached on their sides to each other at adjacent corners. The upwardly tapered panels are also attached to the side panels of the mid-section along a bottom perimeter and to a rim 50, which forms part of the inlet 24 and hatch 26 along a top perimeter. The bottom section 48 is similar in shape to the top portion 44. It is formed of a plurality of downwardly tapered panels which are attached to each other at adjacent corners. The downwardly tapered panels are also attached to the side panels of the mid-section along a top perimeter and to the lower portion 42 of the storage containment structure 22 along a bottom perimeter. The bottom section 48 is funnel-shaped and acts to direct the bulk material downwardly towards the bottom of the container 10 and ultimately out of the container upon dispensing.

In the embodiment where the upper portion 40 and lower portion 42 are formed of fiber reinforced panels, carbon graphite panels or thin sheet steel, the upper portion 40 and lower portion 42 are attached to the top 14 and bottom 16 of the frame 12 using rivets, threaded fasteners, welding (steel or thermoplastic) or a combination of such attachment techniques. Those of ordinary skill in the art will be aware of other suitable attachment techniques, which may alternatively be used.

The container 10 is formed with a discharge opening 60, which is best shown in FIG. 2. The discharge opening 60 may be equipped with a gate valve or other similar device for controlling the flow of the bulk material out of the containment structure 22. It may also optionally be configured to allow for choke-feeding of the bulk material out of the container 10.

Furthermore, the top 14 of frame 12 may be completely open as shown in FIG. 2 and not formed with a hatch 26 or other permanent cover. Rather, the storage containment structure 22 may be formed with an opening 27, which may be formed with a lip 29. The lip 29 is useful in removably securing a lid (not shown) to the containment structure 22, e.g., via snap-fit connection or by other means. The benefit of this design is that if the storage containment structure 22 becomes damaged or otherwise becomes in need of replacement, the entire container 10 does not have to be repaired or discarded. Rather, a replacement containment structure 22 can easily be installed into the frame 12. In one exemplary embodiment, the storage containment structure 22 is simply supported within the frame 12 by support bars 52, as best illustrated in FIG. 2. The storage containment structure 22 may optionally fastened to the support bars 52, or just simply sit on said bars under its own weight. The former configuration allows for quick removal of the storage containment structure. This design is also employed in the alternate embodiments described below with reference to FIGS. 3 and 4. In yet another alternative design, the tapered bottom section 48 is formed of a plurality of tapered interconnected panels, which are integrally formed with the frame 12. This embodiment is shown in FIG. 1.

Figure 3:
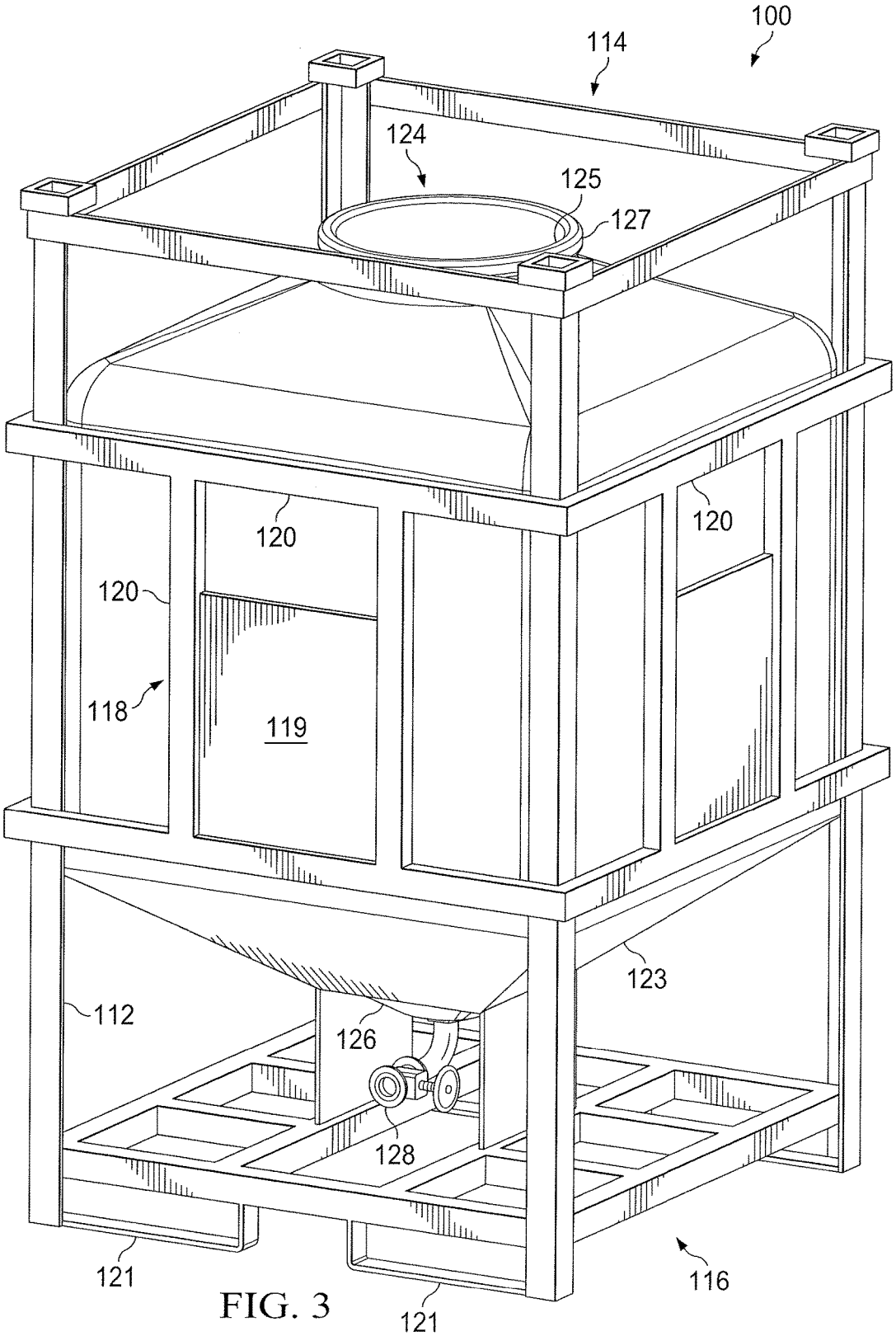
FIG. 3 is an isometric view of a semi-rigid roto-molded type bulk material storage container, in accordance with another embodiment of the present disclosure.
Figure 4:
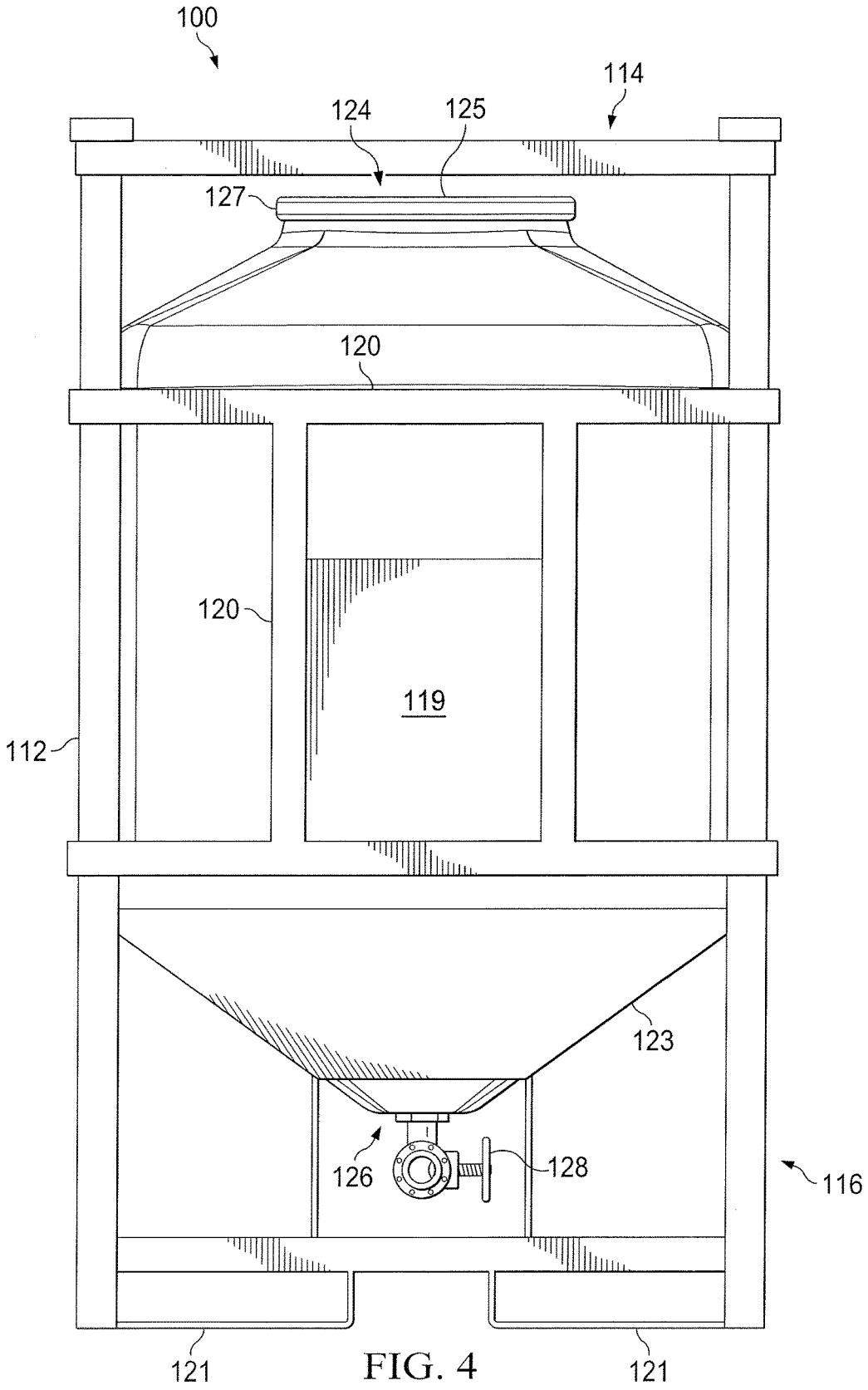
FIG. 4 is a side view of the semi-rigid roto-molded type bulk material storage container shown in FIG. 3 equipped with alternative outlet discharge valve.

FIGS. 3 and 4 show alternative embodiments of the semi-rigid bulk storage container in accordance with the present disclosure. The container in these embodiments is referred to generally by reference numeral 100. The container 100 includes a frame 112, which includes a top 114, a bottom 116 and a plurality of sides 118. The frame is formed of a plurality of rigid bars 120, which in one exemplary embodiment may be formed of steel. The frame may optionally have one or more plates 119, formed between and supported by the rigid bars 120. The frame 112 also comprises a plurality of tapered panels or plates 123 in the bottom portion, which used to support the weight of the containment structure 122 and its contents. As those of ordinary skill in the art will appreciate, however, alternative rigid materials may be used in the construction of the frame 112. The grade/weight of steel or other rigid material utilized should be able to carry the weight of multiple containers such as when the containers are stacked. A pair of parallel channels 121 is attached to the bottom 116 of the frame 112 at generally opposite sides. The channels 121 have a general rectangular cross-section and are designed to accommodate the forks of a forklift. This enables the containers to be easily hoisted onto and off transportation units (not shown) and also moved around a well site. Furthermore, in one exemplary embodiment, the frame 112 is open at the top to enable easy removal and replacement of the storage containment structure 122 in the event of damage or destruction.

The container 100 includes storage containment structure 122, which in this embodiment is formed of a roto-molded plastic material. The benefit of this design is that the storage containment structure 122 can be formed in a single step by machine and at high volume, thus reducing the manufacturing cost of this significant component of the container 100. The roto-molding process also has the benefit of producing a containment structure which has a uniform thickness with a high degree of accuracy. This enables the dimensions to be tightly controlled, and thus enables the containment structures to be manufactured only to a necessary thickness and weight.

The containment structure 122 is an integrally formed structure and is generally cylindrical in its mid-section and may be generally tapered or flat at its top and bottom sections. The containment structure 122 is formed with an inlet 124 at its top and an outlet 126 at its bottom. The inlet 124 comprises an aperture 125 which is designed to allow bulk material to be dispensed easily into the containment structure 122 with minimal to no spillage. A lid (not shown) may be secured to the top of the containment structure 122 over the aperture 125. The lid may be secured to the containment structure 122, e.g., by one or more hinges or may be removable, e.g., through a snap fit seal or via a threaded connection. In the embodiment shown in FIGS. 3-4, the aperture 125 is formed with a lip 127 at the top of the taper. The lip 127 is useful in securing the lid to the containment structure 122, e.g., via snap-fit connection.

The outlet 126 is equipped with a gate valve 128, which may be one of many different designs. Exemplary gate valves include a sliding gate, roller gate, clamshell gate, metering gate or similar device. The gate valve 128 is used to regulate flow of the bulk material out of the containment structure 122. As those of ordinary skill in the art will appreciate, other types of flow control mechanisms can be used to control the flow of bulk material out of the containment structure 122. Also, as those of ordinary skill in the art will also appreciate, electronically controlled gate valves may be used. Such gate valves would be particularly useful in connection with an integrated computerized control system.

It should be noted that the disclosed container 10 may be utilized to provide bulk material for use in a variety of treating processes. For example, the disclosed systems and methods may be utilized to provide proppant materials into fracture treatments performed on a hydrocarbon recovery well. In other embodiments, the disclosed techniques may be used to provide other materials (e.g., non-proppant) for diversions, conductor-frac applications, cement mixing, drilling mud mixing, and other fluid mixing applications.

Although the present disclosure and its advantages have been described in detail, it should be understood that various changes, substitutions and alterations can be made herein without departing from the spirit and scope of the disclosure as defined by the following claims.

What is claimed is:

1. A bulk material storage container, comprising:

a frame wherein the frame comprises:

a top portion;

a bottom portion opposite the top portion;

a plurality of side panels between the top portion and the bottom portion;

a plurality of rigid bars interconnected at each of the plurality of side panels;

one or more plates formed between and supported by the plurality of rigid bars; and a plurality of downwardly tapered panels in the bottom portion, wherein the plurality of tapered panels attach to each other at adjacent corners, and wherein the plurality of tapered panels attach to the plurality of side panels along a top perimeter;

an inlet disposed at the top portion of the frame;

an outlet disposed at the bottom portion of the frame; and a semi-rigid containment structure supported by the frame, wherein the plurality of tapered panels support a weight of the semi-rigid containment structure.

2. The bulk material storage container of claim 1, wherein the semi-rigid containment structure comprises a material selected from the group consisting of a roto-molded plastic, fiber reinforced plastic, carbon graphite, fiberglass and combinations thereof.

3. The bulk material storage container of claim 2, wherein the semi-rigid containment structure having a cylindrical mid-section and top and a tapered bottom.

4. The bulk material storage container of claim 3, wherein the semi-rigid containment structure is integrally formed of a roto-molded polyethylene, polypropylene, polycarbonate, polyvinyl chloride.

5. The bulk material storage container of claim 3, wherein the tapered bottom is integrally formed with the frame.

6. The bulk material storage container of claim 1, wherein the top portion of the frame is open, such that the semi-rigid containment structure supported by the frame may be easily removable from the frame.

7. A bulk material storage container, comprising:

a frame, wherein the frame comprises:

a top portion;

a bottom portion opposite the top portion;

a plurality of side panels between the top portion and the bottom portion;

a plurality of rigid bars interconnected at each of the plurality of side panels;

one or more plates formed between and supported by the plurality of rigid bars; and a plurality of downwardly tapered panels in the bottom portion, wherein the plurality of tapered panels attach to each other at adjacent corners, and wherein the plurality of tapered panels attach to the plurality of side panels along a top perimeter;

a containment structure that is semi-rigid and supported by the frame, wherein the containment structure has a top portion and a tapered bottom portion and is formed of an integrally formed plastic, wherein the plurality of tapered panels support a weight of the containment structure.

8. The bulk material storage container of claim 7, wherein the containment structure is formed of a roto-molded thermoplastic material selected from the group consisting of polyethylene, polypropylene, polycarbonate, polyvinyl chloride, and combinations thereof.

9. The bulk material storage container of claim 7, wherein the frame comprises tapered bottom panels integrally formed therewith which support the containment structure.

10. The bulk material storage container of claim 7, wherein the top portion is sized to permit the containment structure to be removed from the frame.

11. The bulk material storage container of claim 7, further comprising a gate valve coupled to the bottom portion of the containment structure, which in an open position permits bulk material to be dispensed from the containment structure and in a closed position retains the bulk material in the containment structure.

12. The bulk material storage container of claim 11, wherein the gate valve is selected from the group consisting of a sliding gate, roller gate, clamshell gate, metering gate, and combinations thereof.

* * * * *